US007346983B2

(12) United States Patent
Oda et al.

(10) Patent No.: US 7,346,983 B2
(45) Date of Patent: Mar. 25, 2008

(54) METHOD FOR MANUFACTURING SPARK PLUG

(75) Inventors: Syushi Oda, Kuwana (JP); Shigeki Tamura, Inabe (JP)

(73) Assignee: Denso Corporation (JP)

( * ) Notice: Subject to any disclaimer, the term of this patent is extended or adjusted under 35 U.S.C. 154(b) by 352 days.

(21) Appl. No.: 10/921,295

(22) Filed: Aug. 19, 2004

(65) Prior Publication Data

US 2005/0039332 A1 Feb. 24, 2005

(30) Foreign Application Priority Data

Aug. 19, 2003 (JP) ..... 2003-295298
Jun. 22, 2004 (JP) ..... 2004-183867

(51) Int. Cl.
*H01R 43/04* (2006.01)

(52) U.S. Cl. ..... 29/882; 29/746; 29/844; 29/33 N; 313/138; 313/139; 313/141; 445/4; 445/7

(58) Field of Classification Search ..... 29/882, 29/746, 844, 33 N; 313/138, 139, 141; 445/4, 445/7

See application file for complete search history.

(56) References Cited

U.S. PATENT DOCUMENTS 6,790,113 B1 * 9/2004 Fujita ..... 445/7
7,112,112 B2 * 9/2006 Fujita et al. ..... 445/7

FOREIGN PATENT DOCUMENTS

JP 2000-164320 6/2000

* cited by examiner

*Primary Examiner*—Tim Phan
(74) *Attorney, Agent, or Firm*—Nixon & Vanderhye PC

(57) ABSTRACT

A spark plug is provided, for a provisional bending process for manufacturing the spark plug, as a work in a condition where an earth electrode is straight and substantially in parallel with an axial line of a center electrode. In the provisional bending process, two searchers individually facing the tip of the center electrode with the tip located therebetween are arranged, positions of the searchers in a first direction perpendicular to the axial line being adjusted for every spark plug. Then a bending punch is driven to press a second end-surface of the other end of the earth electrode down to the searchers so that the earth electrode is provisionally bent at a substantially perpendicular angle to the axial line, the second end-surface being opposite to the first end-surface. Preferably, before the provisional bending process, positioning the work and correcting the position and tilt of the work are performed.

6 Claims, 14 Drawing Sheets

METHOD FOR MANUFACTURING SPARK PLUG

CROSS REFERENCE TO RELATED APPLICATIONS

This application claims priority to Japan Patent Application Nos. 2003-295298 and 2004-183867, filed on Aug. 19, 2003 and Jun. 22, 2004, respectively.

BACKGROUND OF THE INVENTION

1. Technical Field

The present invention relates to a method and an apparatus for manufacturing spark plugs used by an internal combustion engine mounted on an automobile.

2. Related Art

In an internal combustion engine, spark plugs are used to start the engine. The conventional spark plug is provided with a pillar-like center electrode held in an insulation manner within a housing member and an earth electrode coupled with one end of the earth electrode. The earth electrode is bent at its intermediate predetermined portion so as to make the tip thereof face one end of the center electrode with a space (called "spark gap") formed therebetween.

A conventional method of manufacturing the spark plug is proposed by Japanese Patent Laid-open publication No. 2000-164320. This conventional method uses both of a provisional bending process and a main bending process to produce a spark plug. The earth electrode is first subjected to the provisional bending process, in which the spark gap is formed slightly larger than a specified size, and then subjected to the main bending process. In this main bending process, the spark gap is finely adjusted so that its size falls within a predetermined size range. In the case of this manufacturing method, before the main bending process, the tip surface of the central electrode is measured with regard to its position and other factors. Results from the measurement are used to determine an amount of bending of the earth electrode.

However, the bending technique proposed by the above reference results in that the other end of the earth electrode is positioned differently moment to moment on a plane perpendicular to an axial line axially passing the center electrode (, which is referred to as "a center-electrode axial line"). Thus, in the spark plug in which a noble metal chip is welded to the earth electrode, the position of the noble metal chip on the plane perpendicular to the center-electrode axial line is dependent on situations. Thus accuracy in the concentric factor between the center electrode and the noble metal chip is forced to be lowered, which is one reason of deteriorations in the ignitionability of a spark plug.

SUMMARY OF THE INVENTION

The present invention has been made with due consideration to the foregoing difficulty, and an object of the present invention is to raise accuracy in the concentric factor between the center electrode and the noble metal chip after the provisional bending process of the earth electrode, thus providing the spark plug of higher precision.

In order to achieve the object, there is provided a method for manufacturing a spark plug provided with a housing, a substantially cylindrical center electrode is held in a insulated manner in the housing with a tip of the center electrode protruding from the housing, an earth electrode having both ends one of which is joined to the housing, and a noble metal chip joined on a first end-side surface of the other end of the earth electrode, the earth electrode being bent to form a spark gap between the noble metal chip and the tip of the center electrode. The comprises the steps of: providing, for a provisional bending process for the manufacture, the spark plug as a work in a condition where the earth electrode is straight and substantially in parallel with an axial line of the center electrode; and performing the provisional bending process. This process is carried out by (i) arranging two searchers individually facing the tip of the center electrode with the tip located therebetween, positions of the searchers in a first direction perpendicular to the axial line being adjusted for every spark plug, and (ii) driving a bending punch to press a second end-surface of the other end of the earth electrode down to the searchers so that the earth electrode is provisionally bent at a substantially perpendicular angle to the axial line, the second end-surface being opposite to the first end-surface.

The spatial position of the earth electrode, that is, the noble metal chip in the direction perpendicular to the axial line of the center electrode is adjusted work by work. It is therefore possible to raise accuracy in the concentric factor between the center electrode and the noble metal chip after the provisional bending process of the earth electrode. The spark plug of higher precision can be provided.

Preferably, prior to the provisional bending process, various preparation processes can be done. One example is (i) positioning the work so as to make the earth electrode substantially agree to the axial line of the earth electrode when the work held by the holder is viewed along a first direction perpendicular to the axial line before provisional bending process; (ii) measuring, after the positioning, a first shift amount between the axial line and the earth electrode in a second direction being perpendicular to both the axial line and the first direction, the first shift amount being viewed in the first direction; (iii) correcting a position of the earth electrode by rotating the holder based on the measured first shift amount; (iv) measuring, after correcting the position of the earth electrode but before provisionally bending the earth electrode, a tilt of the earth electrode to the axial line of the center electrode; and (v) correcting the tilt of the earth electrode based on the measured tilt.

Another preferred example is to perform a combination of only the above preparation processes (i) to (iii). This configuration is very useful for accurately detecting, prior to the provisional bending operation, a positional relationship between the respective electrodes and cameras for the measurements, thus leading to an improved coaxiality between the center electrode and the noble metal chip after the provisional bending operation. Still, another preferred example is to perform a combination of only the above preparation processes (iv) to (v). This configuration also makes it possible that a positional relationship between the earth electrode and the noble metal chip before the provisional bending operation is grasped in an accurate manner. Accordingly, the coaxiality between the center electrode and the noble metal chip after the provisional bending operation is improved largely.

Various other configurations and advantages thereof will be made clear in the accompanying drawings and the descriptions in the embodiments.

BRIEF DESCRIPTION OF THE DRAWINGS

Other objects and aspects of the present invention will become apparent from the following description and embodiments with reference to the accompanying drawings in which.

DETAILED DESCRIPTION OF PREFERRED EMBODIMENTS

In connection with accompanying drawings, preferred embodiments of the present invention will now be described.

First Embodiment

In connection with FIGS. 1 to 10, a first embodiment will now be described.

Figure 1:
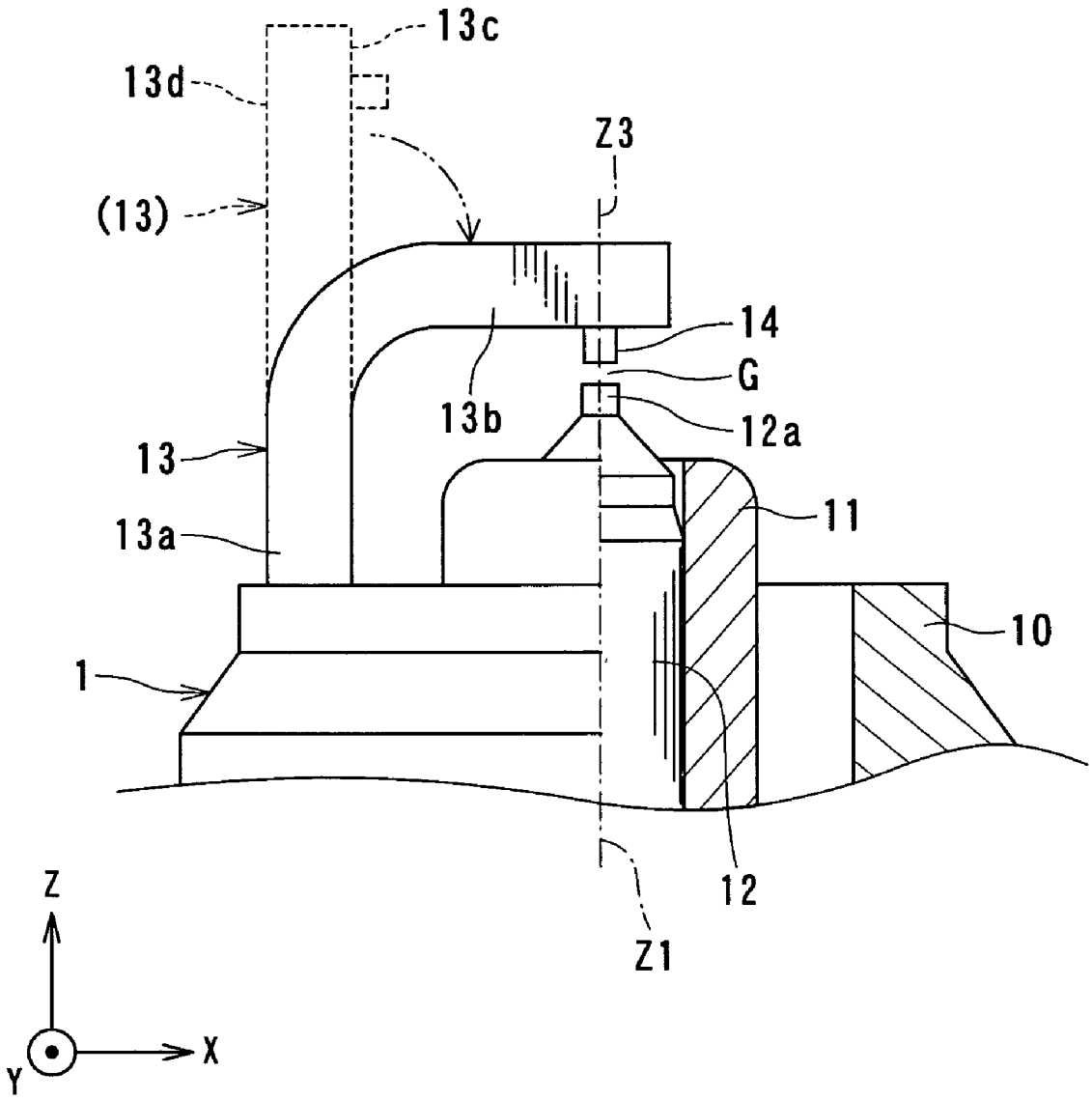
FIG. 1 is a semi-sectional view showing a spark plug based on the manufacturing method according to the present invention.

FIG. 1 shows a semi-cross section of the front partial view of a spark plug 1 manufactured based on the manufacturing method according to the present invention. As shown, the spark plug 1 is provided with an approximately cylindrical housing 10 made of a conductive steel material. A substantially cylindrical porcelain insulator 11, made of ceramic, which is highly insulative, is inserted and fixed in the housing 10, with its one end protruding from one end of the housing 11. An axial hole is formed in the porcelain insulator 11.

A center electrode 12 made of a conductive metal material and formed into a substantially cylindrical shape is inserted and fixed in the axial hole of the porcelain insulator 11. A platy earth electrode 13 made of Ni (Nickel)-based alloy is joined on one axial end of the housing 10. On end of the earth electrode 13, there is bonded a columnar noble metal chip 14 made of waste resistant material against spark, such as Ir (iridium) alloy.

In the present embodiment, for the sake of an easier understanding of the directions of the spark plug 1, the XYZ orthogonal coordinate system is introduced as shown in FIG. 1, such that the axial (longitudinal or length-ward) direction of the center electrode 12 is assigned to the Z-axis direction.

During the production of the spark plug 1, the earth electrode 13 is subjected to two-stage bending processes consisting of a provisional bending process and a main bending process. The provisional bending process precedes the main bending one, so that the provisional bending process serves as a first bending process according to the present invention. The term "provisional" may be replaced by other equivalent terms such as "temporal," "previous" or "preparation." And the term "main" may also be replaced by other equivalent terms such as "primary" or "post." Accordingly the main bending process is set to finally and finely bend the earth electrode 13 so as to locate the noble metal chip 14 on the earth electrode 13 in place. The main bending process therefore corresponds to a second bending process according to the present invention.

As shown by a dotted line in FIG. 1, the earth electrode 13 has a straight shape which is in parallel with an axial line Z1 of the center electrode 12 (hereinafter referred to as a "center-electrode axial line Z1"), before the provisional bending process. Once the earth electrode 13 undergoes the provisional bending process, the electrode 13 is bent into a substantial L shape, as shown by a solid line in FIG. 1 in dotted line and solid line.

Then, the earth electrode 13 is further bent through the main bending process to form a spark gap G with a given length, as shown in FIG. 1.

When viewing the bent shape of the earth electrode 13, the earth electrode 13 is essentially composed of a straight base part 13*a* and a laterally bent end part 13*b* continuously extending from the straight base part 13*a*. That is, the straight base part 13*a* straight extends in the Z-axis direction substantially in parallel with the center-electrode axial line Z1. On the other hand, the laterally bent end part 13*b* that extends in the X-axis direction substantially perpendicular to the center electrode axial line Z1.

A noble metal chip 14 is bonded on one surface of the laterally bent end part 13*b* of the earth electrode 13 so that the chip 14 faces a tip 12*a* of one axial end of the center electrode 12. The spark gap G of a given length is thus formed between the noble metal tip 14 and the tip 12*a* of the center electrode 12 in the direction along the center electrode axial line Z1.

Figure 2:
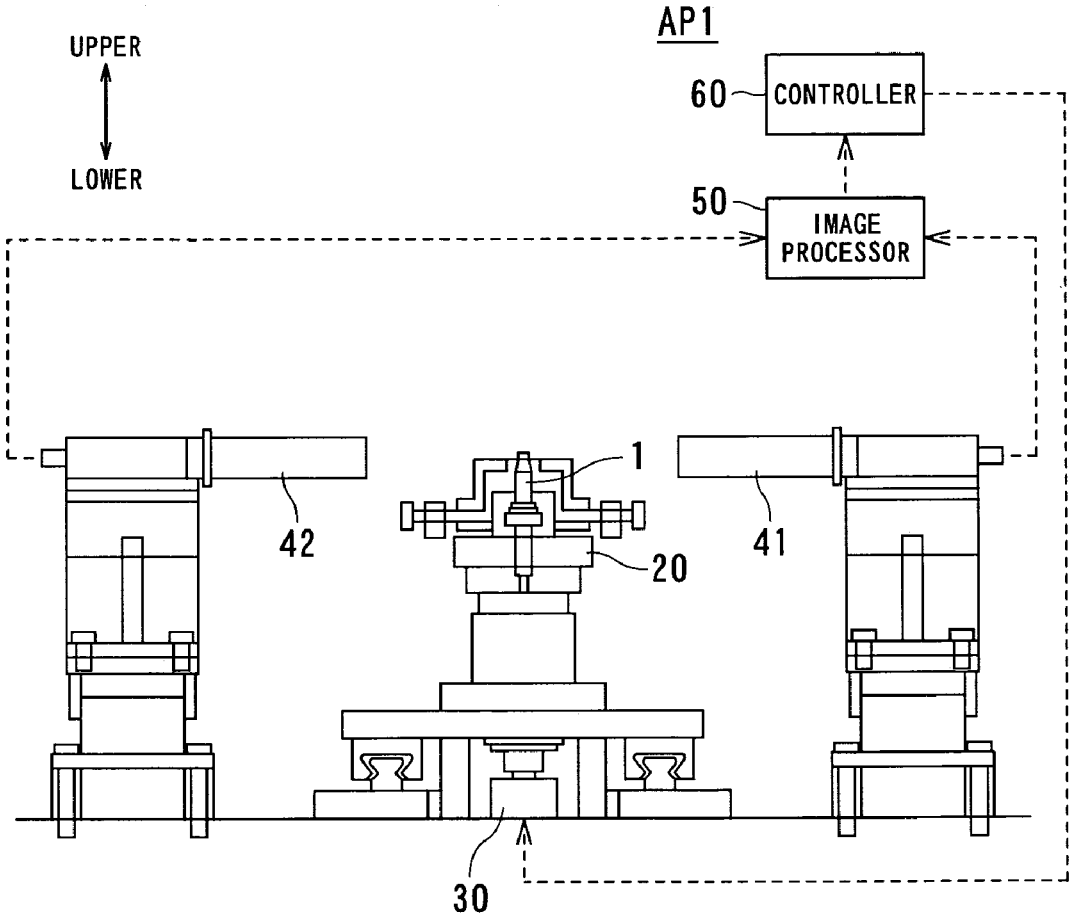
FIG. 2 is the frontal view pictorially showing a preparatory processing apparatus according to a first embodiment of the present invention.
Figure 3:
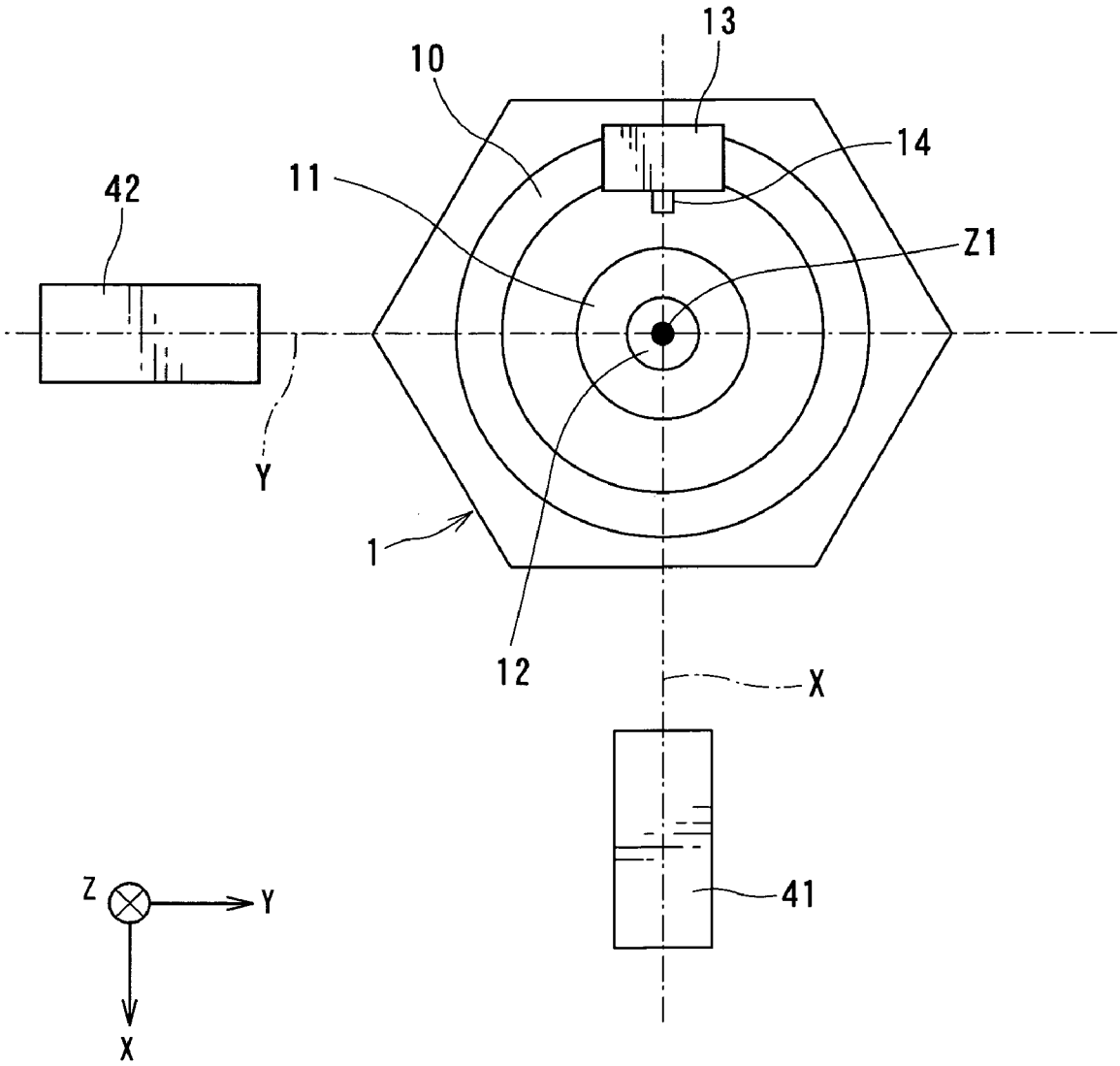
FIG. 3 is a plan view explaining the arrangement of cameras used by the preparatory processing apparatus.
Figure 4:
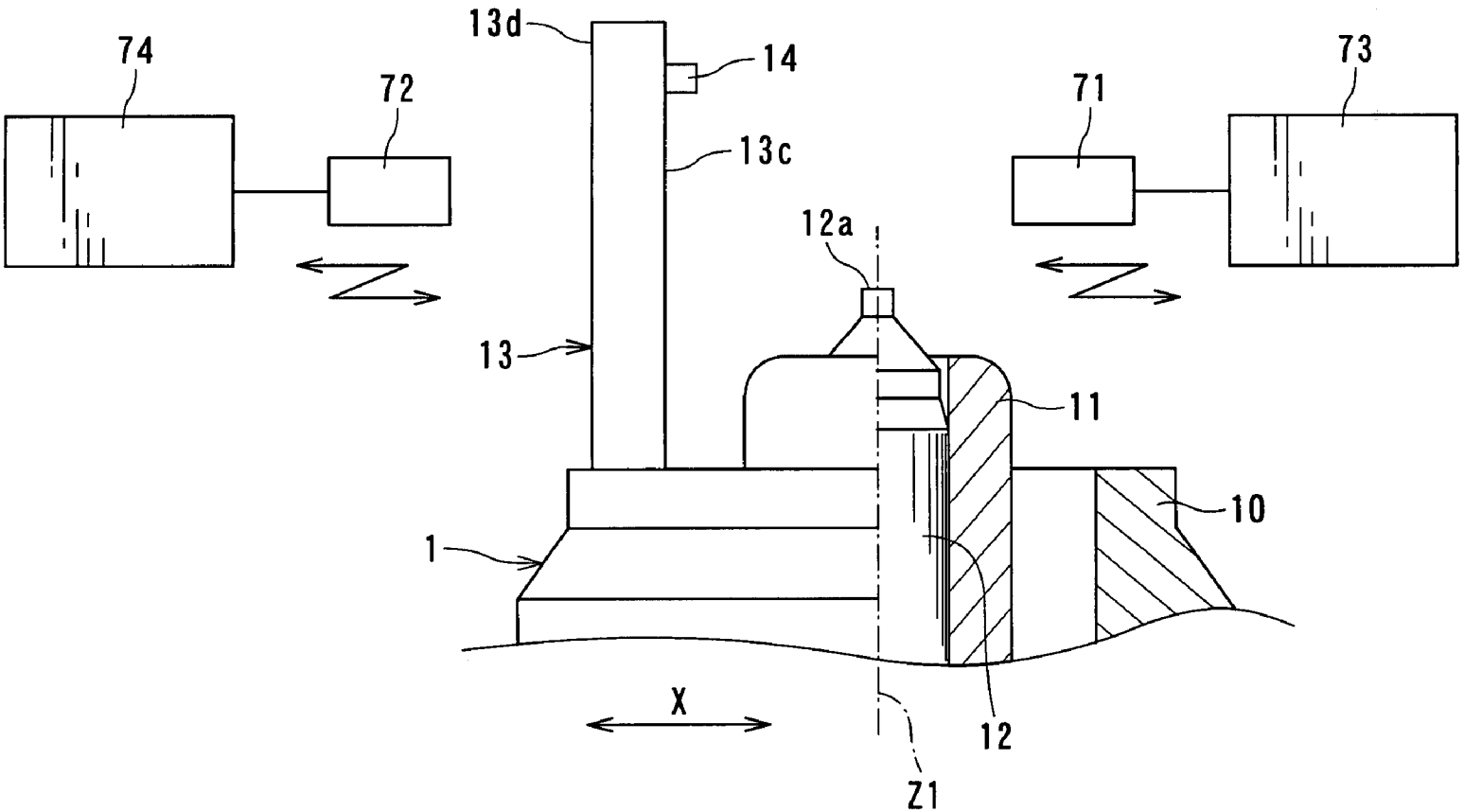
FIG. 4 pictorially shows part of the preparatory processing apparatus.

Referring to FIGS. 2 to 4, a preparatory processing apparatus AP1 used in a preparatory step preceding the provisional bending process will now described.

As shown in FIG. 2, this apparatus AP1 includes, as mechanical components, a holder 20 for fixing a work (i.e., spark plug 1) with the spark gap G kept upward and a holder driving unit 30 for rotating the holder 20 so the spark plug 1 is rotated about its center-electrode axial line Z1.

Further, as electrical components, the preparatory processing apparatus AP1 is provided with two cameras 41 and 42 arranged to image predetermined spatial regions each containing both the electrodes 12 and 13, an image processor 50 for processing image signals from the cameras 41 and 42 into images, and a controller 60 for controlling the holder driving unit 30 and other later-described driving units based on the signal from the image processor 50. The holder driving unit 30 employs servo motors.

The image processor 50 is equipped with an interface and a universal image processing unit (not shown) with a computer system including a dedicated CPU (central processing unit) and some memories. Thus the image processor 50 operates on a predetermined software algorism which has been read out from a memory so that video signals from the cameras 41 and 42 are processed into images of a predetermined format. In addition, the image processor 50 analyzes the images to find out three-dimensional coordinates of the positions of components including both the center electrode 12 and the earth electrode 13.

The controller 60 is equipped with, by way of example, a programmable logic controller (PLC) and operates using signals from the image processor 50. Specifically, the controller 60 uses such signals to control the holder driving unit 30 and others, so that the operations of the holder 20 and others are controlled.

As shown in FIG. 3, the two cameras 41 and 42 are arranged to image predetermined three-dimensional regions each including the electrodes 12 and 13 in two directions perpendicular to each other. Hence, this imaging can also be done prior to provisionally bending the earth electrode 13. The imaging direction of the first camera 41 is made to agree with the X-axis direction (refer to FIG. 3). In contrast, the imaging direction of the second camera 42 is made to agree to the Y-axis direction perpendicular to both the center electrode axial line Z1 and the X-axis direction.

The preparatory processing apparatus AP1 shown in FIG. 2 is provided with adjusting punches 71 and 72 and punch driving units 73 and 73 for driving the adjusting punches 71 and 72, respectively, which are depicted in FIG. 4.

The first adjusting punch 71 is arranged to face a side surface 13*c* of the earth electrode 13 on which the noble metal chip 14 is mounted, in which the earth electrode 13 has yet to be subjected to the provisional bending process. Hereinafter the surface 13*c* is referred to as a "chip-mounted surface." Further, the first adjusting punch 71 is connected to the first punch driving unit 73 operating under the control of the controller 60, whereby the punch 71 can be driven by the driving unit 73 in the X-axis direction.

The second adjusting punch 72 is arranged to face another side surface 13*d* of the earth electrode 13 which is back to back to the chip-mounted surface 13*c*, in which the earth electrode 13 has yet to be subjected to the provisional bending process. Hereinafter the surface 13*d* is referred to as an "opposite-to-chip surface." Further, the second adjusting punch 72 is connected to the second punch driving unit 74 operating under the control of the controller 60, whereby the punch 72 can be driven by the driving unit 74 in the X-axis direction.

The first and second punch driving units 73 and 74 employ servo motors or hydraulic (or air) cylinders.

Figure 5:
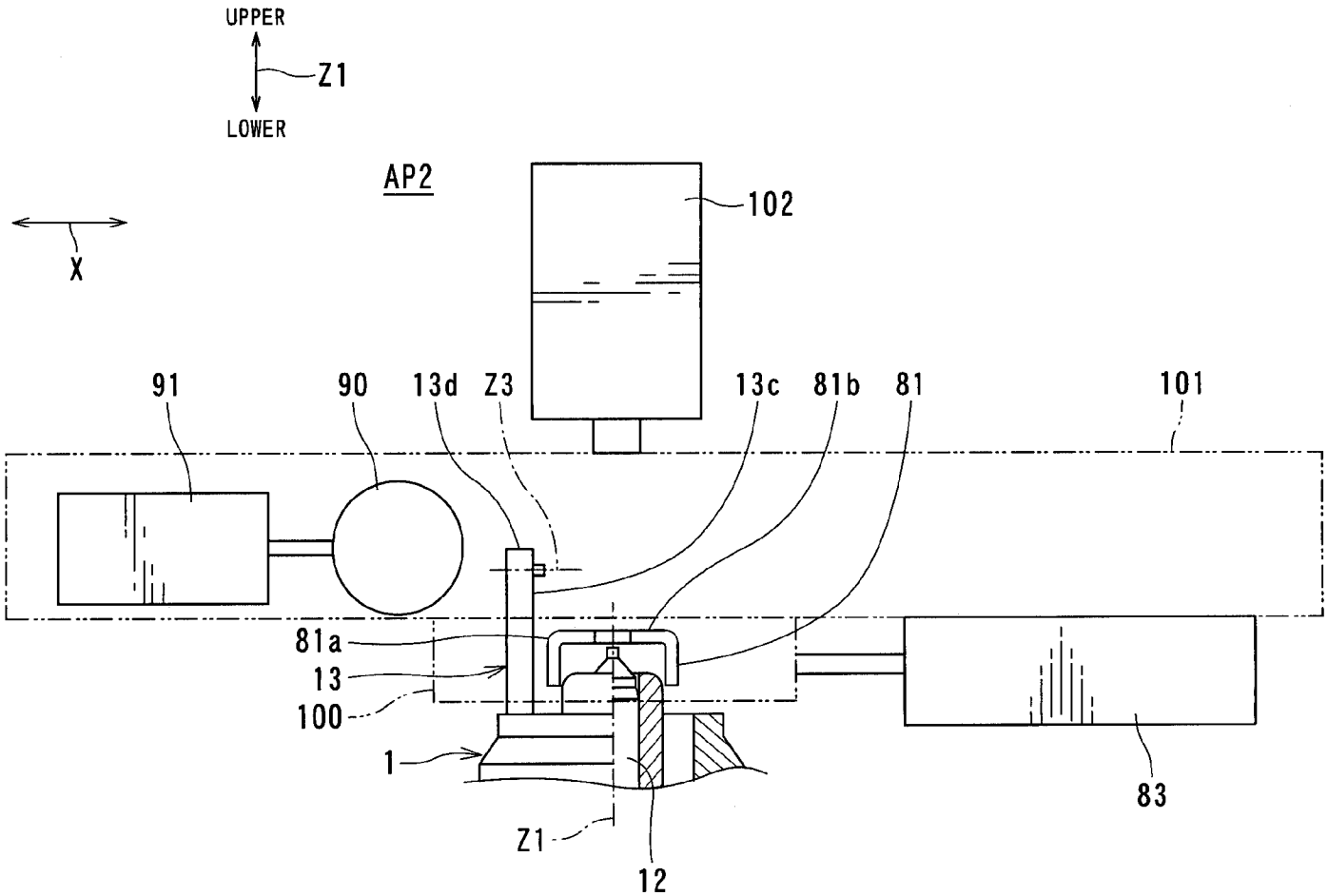
FIG. 5 is a frontal view pictorially showing a provisional bending apparatus according to the first embodiment.
Figure 6:
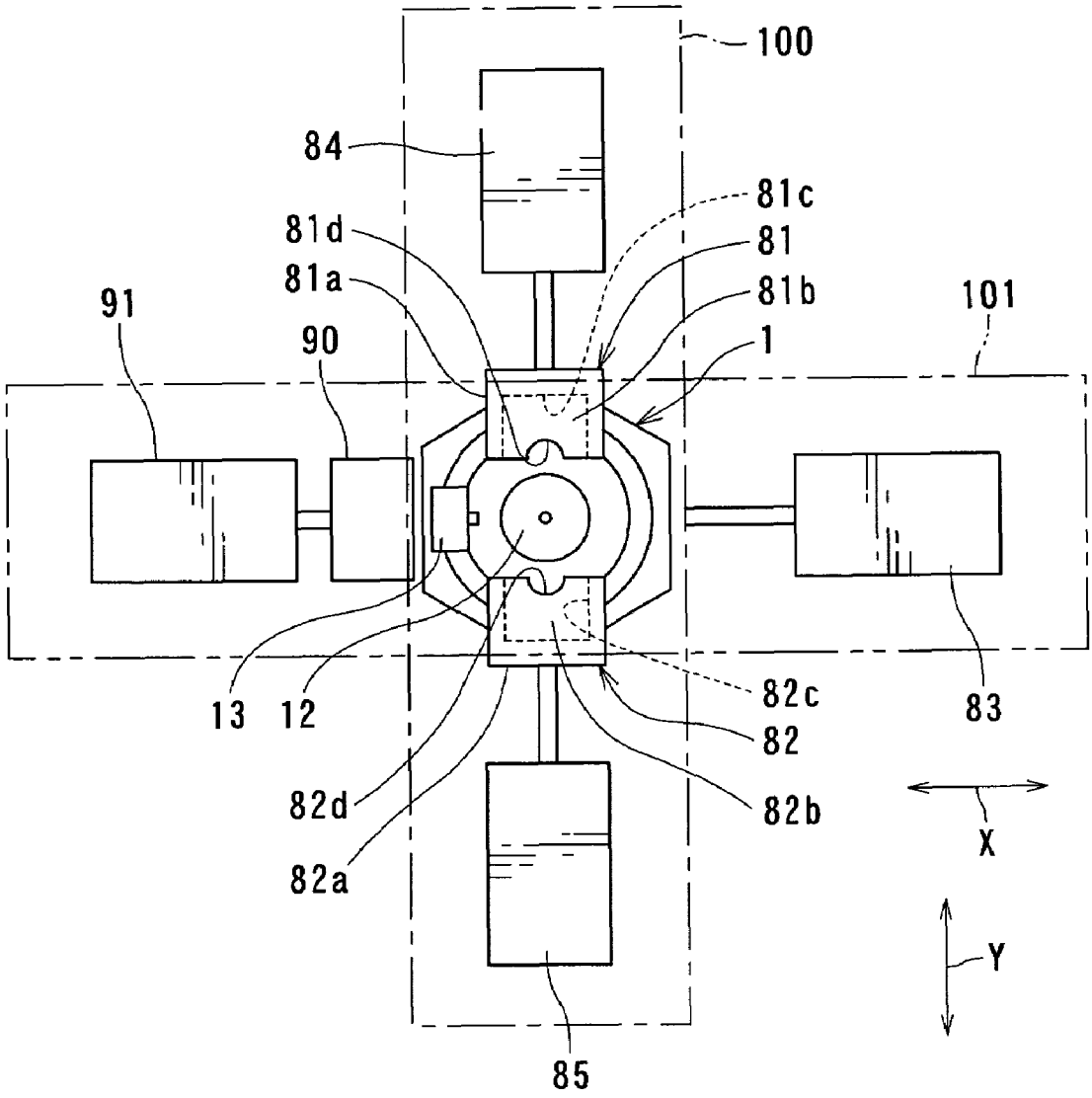
FIG. 6 shows the plan view of the provisional bending apparatus shown in FIG. 5.

FIGS. 5 and 6 illustrate a provisional bending apparatus AP2, which has the capability of giving the provisional bending process to the work, that is, the spark plug 1 held by the preparatory processing apparatus AP1. In other words, the spark plug 1 held by the preparatory processing apparatus AP1 is transferred to the provisional bending process performed by the provisional bending apparatus AP2 without being removed from the apparatus AP1.

As shown in FIGS. 5 and 6, the provisional bending apparatus AP2 is equipped with two searchers 81 and 82 and a provisional bending punch 90. The two searchers 81 and 82 are arranged face to face, as shown in FIG. 6, in a condition where the tip 12*a* of the center electrode 12 exists between the two searchers 81 and 82 and the chip-mounted surface 13*c* of the earth electrode 13 faces both the searchers 81 and 82 in a perpendicular geometry to the searchers 81 and 82. In contrast, the provisional bending punch 90, which is shaped in a cylinder, is disposed to face the opposite-to-chip surface 13*d* of the earth electrode 13.

Both of the two searchers 81 and 82 are secured on a searcher block 100, so that the searchers 81 and 82 can be moved by the searcher block 100 in the Y-axis direction. The provisional bending punch 90 is mounted on the searcher block 100, so that the searchers 81 and 82 can be moved by the searcher block 100 in the Y-axis direction. The searcher block 100 itself is secured to a common block 101, which allows the searcher block 100 to move in the X-axis direction.

The common block 101 is constructed such that it can be driven by a block Z-axis driving unit 102 so as to move in the directions along the center-electrode axial line Z1. The searcher block 100 is coupled with a searcher X-axis driving unit 83 secured to the common block 101, so that the searcher block 100 is moved in the X-axis direction.

Moreover, the first searcher 81 is configured such that it can be driven in the Y-axis direction by a first searcher Y-axis driving unit 84 secured to the searcher block 100. The second searcher 82 is configured such that it can be driven in the Y-axis direction by a second searcher Y-axis driving unit 85 secured to the searcher block 100. As to the provisional bending punch 90, a provisional bending punch driving unit 91 attached to the common block 101 is placed to drive the punch 90 in the X-axis direction.

When the provisional bending process is started, first side surfaces 81*a* and 82*a* of the two searchers 81 and 82 are first made to touch the tip-mounted surface 13*c* of the earth electrode 13, the first side surfaces 81*a* and 82*a* being located to face the earth electrode 13. Then the provisional bending punch 90 is driven to push the opposite-to-chip surface 13*d* of the earth electrode 13 in a manner that the bent earth electrode 13 is pressed onto second side surfaces 81*b* and 82*b* of the two searchers 81 and 82, the second side surfaces 81*b* and 82*b* being located oppositely to the center electrode 12. Hereinafter, if necessary, the second side surfaces 81*b* and 82*b* are refereed to as "opposite-to-center-electrode surfaces."

On the two searchers 81 and 82, recess portions 81*c* and 82*c* and notches 81*d* and 82*d* are formed, respectively, as depicted in FIGS. 5 and 6. The recess portions 81*c* and 82*c* are formed to avoid interferences with the porcelain insulator 11 and the center electrode 12 during the provisional bending process. The notches 81*d* and 82*d* are required to avoid interferences with the noble metal chip 14 during the provisional bending process.

The driving units 83, 84, 85, 91 and 102 in the provisional bending apparatus AP2 use servo motors or hydraulic (or air) cylinders.

Figure 10:
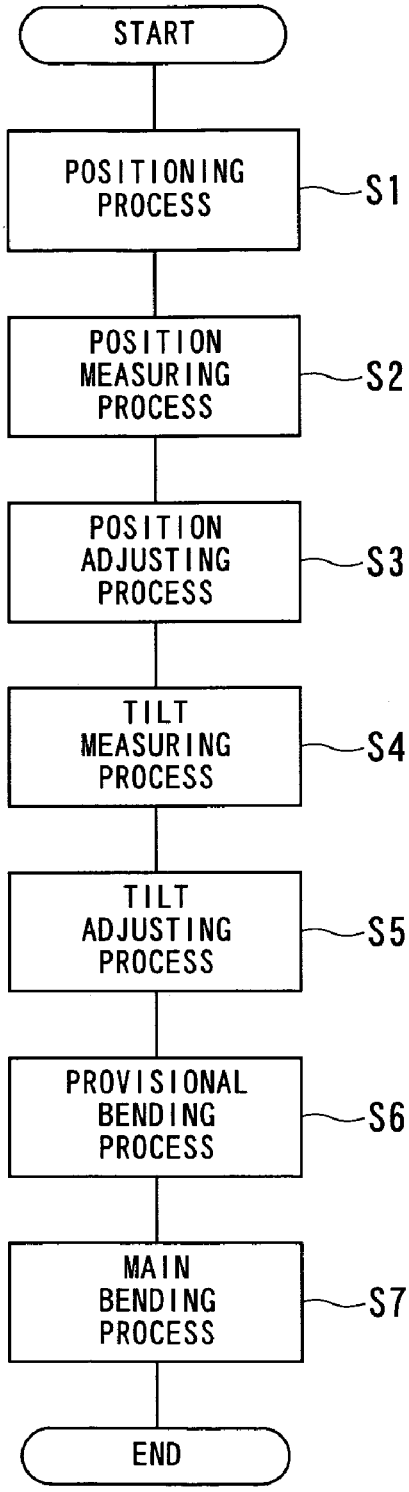
FIG. 10 outlines the procedures of both the provisional and main bending processes carried out in the first embodiment.

The provisional and bending processes performed by the foregoing apparatuses AP1 and AP2 will now be explained in the order of processes shown in FIG. 10. The processes are carried out under the control of the controller 60.

(Positioning Process (Step S1 in FIG. 10))

As shown in FIG. 2, a work, that is, a spark plug 1 which has not yet experienced the provisional bending operation of its earth electrode 13, is held by the holder 20 in an attitude where both of the earth electrode 13 and the tip 12*a* of the center electrode 12 are located upward. During this holding operation, the work is adjusted in its position to the holder 20 so that the center-electrode axial line Z1 almost agrees to the earth electrode 13 in cases where the first camera 41 views a spatial region including both the electrodes 12 and 13.

(Position Measuring Process (Step S2 in FIG. 10))

Figure 7:
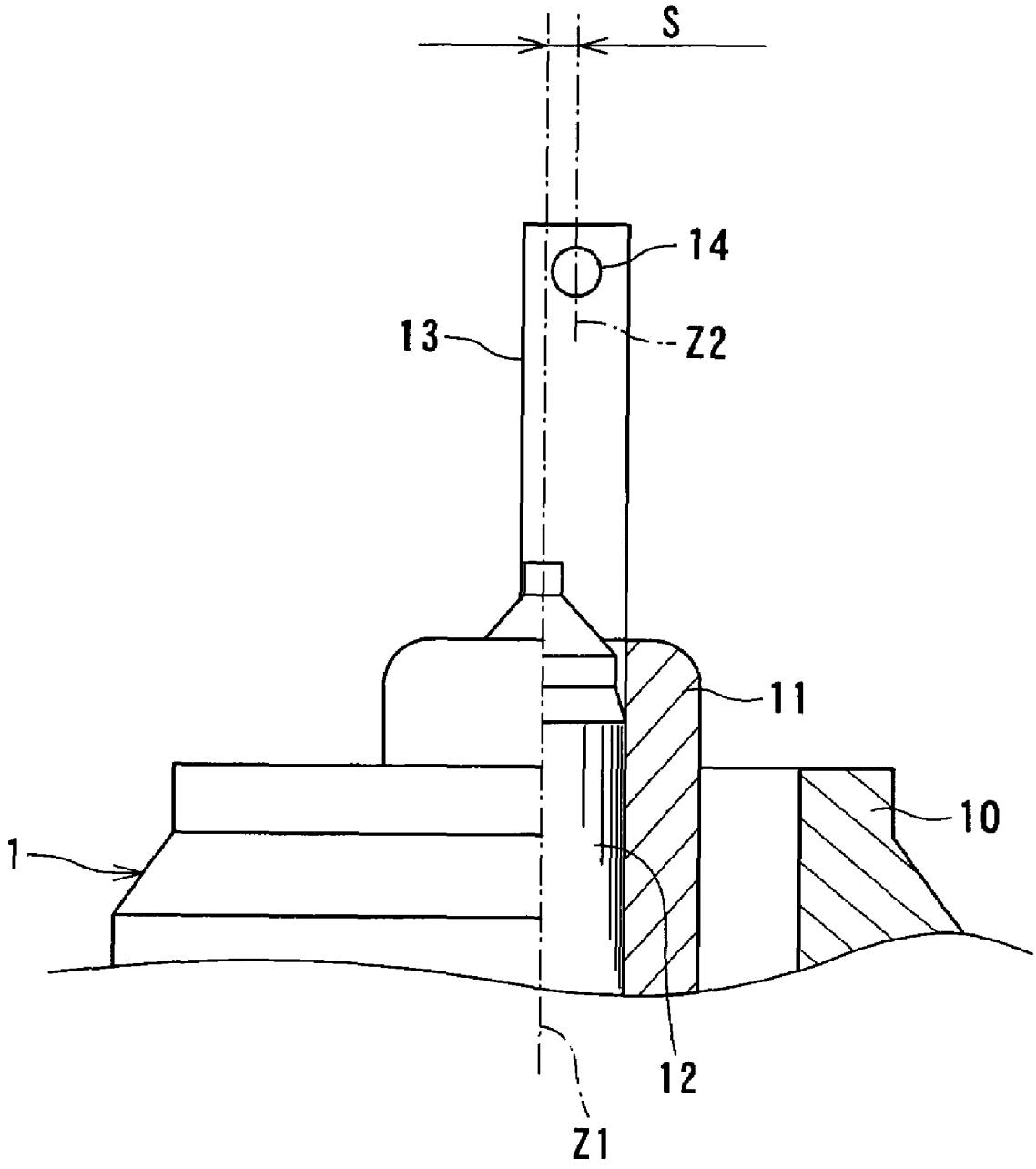
FIG. 7 exemplifies an X-axis directional image taken by a first cameral placed in the X-axis direction, the image being taken after a positioning process and being a view of a predetermined spatial region including center and earth electrodes.

After the positioning process, the first camera 41 is controlled to take an image of the spatial region including both the electrodes 12 and 13. Such an image is exemplified in FIG. 7. After the positioning process, the image processor 50 processes image signals coming from the first camera 41 in order to measure a first shift amount (distance) S between the center-electrode axial line Z1 and an axial line Z2 of the earth electrode 13 (hereinafter referred to as an "earth-electrode axial line Z2") in the Y-axis direction. The first shift amount S is depicted in FIG. 7.

(Position Adjusting Process (Step S3 in FIG. 10))

After the above position measuring process, the manufacture is shitted to a position adjusting process. In other words, measured results in the position measuring process are used to adjust the position of the earth electrode 13 by rotating the holder 20 in a direction which allows the first shift amount S to decrease. To be specific, the first shift amount is converted to a corresponding angle and the holder driving unit 30 is driven to rotate the holder 20 in compliance with the obtained angle.

(Tilt Measuring Process (Step S4 in FIG. 10))

Figure 8:
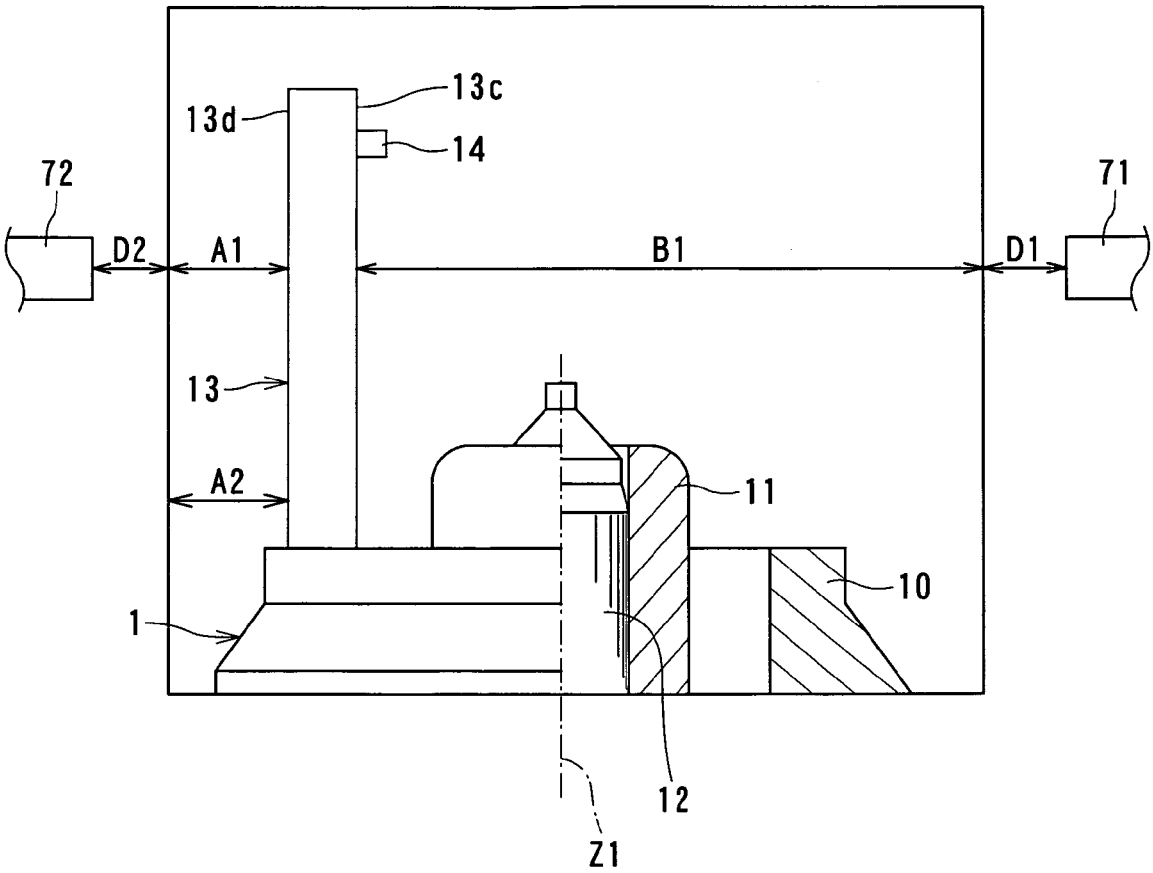
FIG. 8 exemplifies a Y-axis directional image taken by a second cameral placed in the Y-axis direction, the image being taken after a position adjusting process and being a view of a predetermined spatial region including the center and earth electrodes.

When completing the position adjusting process, a tilt measuring process is performed. That is, the image processor 50 starts to process image signals from the second camera 42, after the position adjusting process. FIG. 8 illustrates an image taken by the second camera 42 after the position adjusting process, the image representing the predetermined spatial region including the electrodes 12 and 13. The image processor 50 measures a tilt of the earth electrode 13 to the center-electrode axial line Z1. In this stage, the earth electrode 13 has not yet been subjected to the provisional bending operation.

How to compute the tilt is as follows. As shown in FIG. 8, on the taken image, two distances A1 and A2 each extending from the image left edge to the opposite-to-chip surface 13*d* are measured at different two positions in the center-electrode axial line Z1. The measured distances A1 and A2 are used to compute how much tilt is owned by the earth electrode 13 to the center-electrode axial line Z1. In this process, a distance B1 from the image right edge to the tip-mounted surface 13*c* is measured as well.

(Tilt Adjusting Process (Step S5 in FIG. 10))

When the tilt measuring process is completed, the measured results are reflected into a tilt adjusting process to adjust the attitude of the earth electrode 13 by reducing the tilt thereof.

A practical example is as follows. If a condition of A1−A2>0 is met, the first adjusting punch 71 is driven to press the tip-mounted surface 13*c* of the earth electrode 13. In contrast, when a condition of A1−A2<0 is met, the second adjusting punch 72 is driven to press the earth electrode 13 from the opposite-to-chip surface 13*d* thereof. Though the first and second adjusting punches 71 and 72 are driven on distances C1 and C2, such distances C1 and C2 are computed on the following formulas.

In the case of A1−A2>0 is realized, $$C1=B1+(A1-A2)+SP1+D1$$

can be formulated, where SP1 is a springback amount and D1 is a distance from the image right edge to the earth-electrode-side tip of the first adjusting punch 71 when the first adjusting punch 71 is located at its original position (refer to FIG. 8).

By contrast, in the case of A1−A2<0 is realized, $$C2=B1+(A2-A1)+SP1+D2$$

can be formulated, where D2 is a distance from the image left edge to the earth-electrode-side tip of the second adjusting punch 72 when the second adjusting punch 72 is located at its original position (refer to FIG. 8). Data of the distances D1 and D2 are previously stored in a memory in the image processor 50.

(Provisional Bending Process (Step S6 in FIG. 10))

Then the provisional bending process is carried out, where, first of all, the respective geometric dimensions relating to various components including both the electrodes 12 and 13 that have undergone the tilt adjusting process are again measured by the image processor 50 receiving image signals from the cameras 41 and 42. The measured results are used by the controller 60 to calculate positions to be targeted of the searchers 81 and 82 for provisionally bending the earth electrode 13. Under the control of the controller 60, the searchers 81 and 82 are then driven to move to the calculated target positions to prepare for the provisional bending operation for the earth electrode 13.

Figure 9:
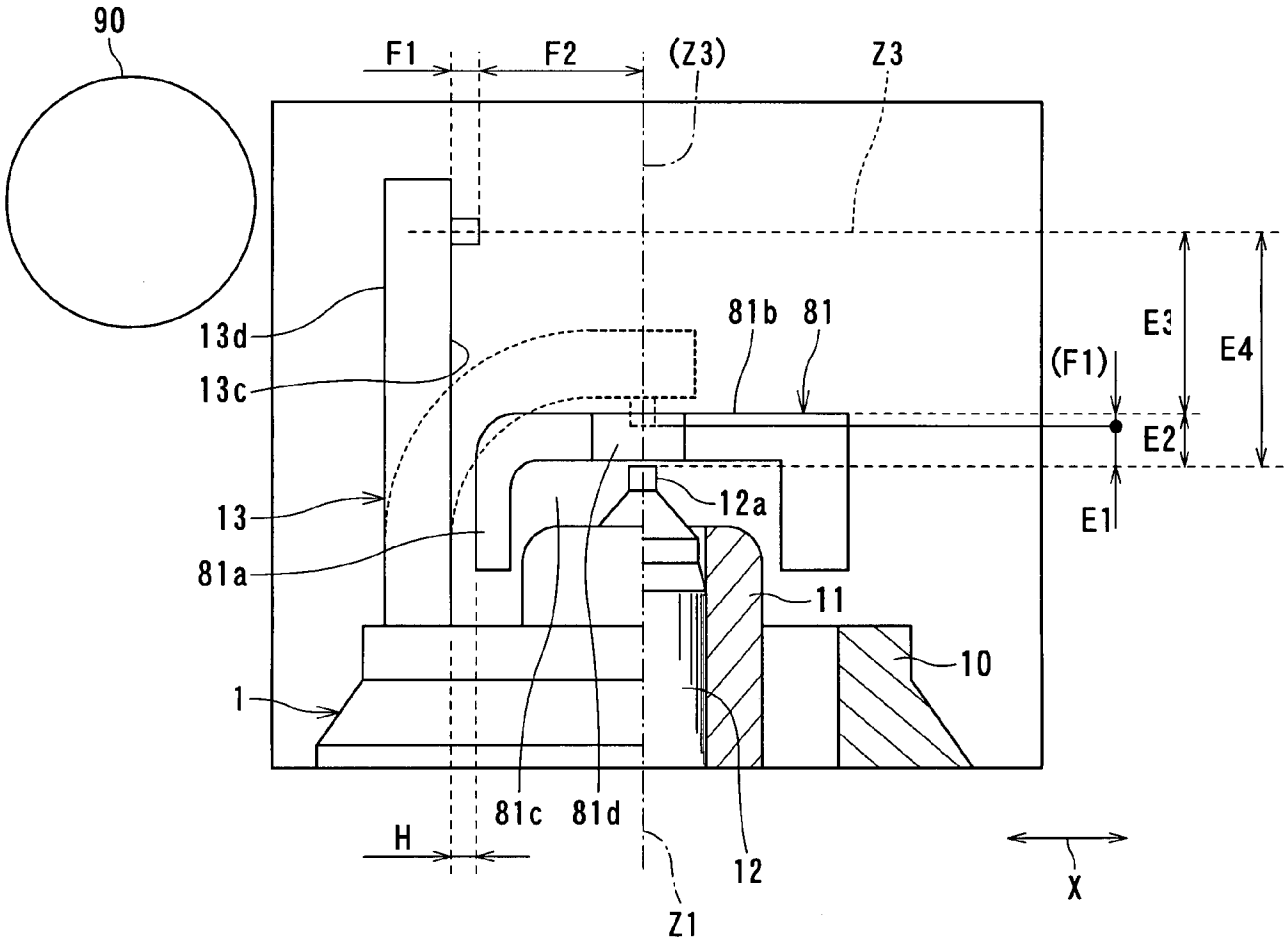
FIG. 9 exemplifies a Y-axis directional image taken by the second cameral placed, the image being taken after the position adjusting process but before a provisional bending process for the earth electrode and being the view of a predetermined spatial region including the center and earth electrodes.

This process will now be detailed. FIG. 9 exemplifies an image taken by the second camera 42, in which the image shows the predetermined spatial region including both the electrodes 12 and 13 after the tilt adjusting process but before the provisional bending process.

In FIG. 9, a dotted L-shape line shows a contour to which the earth electrode 13 should be bent through this provisional bending process. Furthermore, references E1 to E4 in FIG. 9 denote distances to be targeted in the center-electrode axial line Z1.

Of these the reference E1 denotes a distance to be targeted (which should be kept after the provisional bending process) from the tip 12*a* of the center electrode 12 to the tip of the noble metal chip 14 on the earth electrode 13. Data of this distance E1 is also held by the controller 60 in advance. The reference E2 denotes a distance to be targeted (which should be kept during the provisional bending process) from the tip 12*a* of the center electrode 12 to the opposite-to-center-electrode surfaces 81*b* and 82*b* of the searchers 81 and 82.

The reference E3 denotes a distance from the opposite-to-center-electrode surfaces 81*b* and 82*b* of the searchers 81 and 82 located for the provisional bending operation to an axial line Z3 axially passing the noble metal chip 14 located before the provisional bending process. Hereinafter the axial line Z3 refers to as a "chip-axial line Z3." Further, the reference E4 denotes a distance measured before the provisional bending process, the distance being measured from the tip 12*a* of the center electrode 12 to the chip-axial line Z3.

As shown, FIG. 9 includes further references F1, F2 and H. The reference F1 denotes a height of the noble metal chip 14 protruding from the earth electrode 13. The reference F2 denotes a distance in the X-axis direction, which is measured before the provisional bending process. This distance F2 is taken from the tip of the chip 14 located before the provisional bending process to the center-electrode axial line Z1. Finally, the reference H denotes the size of a gap to be targeted in the X-axis direction, the gap size being measured from the chip-mounted surface 13*c* of the earth electrode 13 located before the provisional bending process to the first side surfaces 81*a* and 82*a* (which face the earth electrode 13) of the two searchers 81 and 82 disposed for the provisional bending process.

The dimensions E2 and H targeted by the searchers 81 and 82 are calculated as follows.

$$E2=E+F1-SP2$$

$$H=(F1+F2)-(E4-E2)-SP3$$

In these formulas, SP2 is a springback amount in the center-electrode axial line Z1 and SP3 is a springback amount in the X-axis direction.

The calculated dimensions E2 and H are used to position both the searchers 81 and 82 (refer to FIG. 9), and the provisional bending punch 90 is moved toward the center electrode 12 in the X-axis direction. This move allows the punch 90 to press (push) the opposite-to-chip surface 13*d* of the earth electrode 13 in the X-axis direction, resulting in the earth electrode 13 which is bent at its almost length-ward middle portion to form an approximately L-shape, as shown by the dotted line in FIG. 9. In this bent state, the bent upper portion of the earth electrode 13 is pressed onto the opposite-to-center-electrode surfaces 81*b* and 82*b* of the searchers 81 and 82.

In this way, using the calculated dimension E2, the opposite-to-center-electrode surfaces 81*b* and 82*b* of the searchers 81 and 82 are positioned in the center-electrode axial line Z1, and the earth electrode 13 is then subjected to the provisional bending operation. Therefore, this makes it possible that the dimension E1 measured after the provisional bending operation almost agrees with the target value.

In addition, positioning the first side surfaces 81*a* and 82*a* of the searchers 81 and 82 in the X-axis direction enables the noble metal chip 14 to be adjusted in its position in the X-axis direction after the provisional bending operation. In other words, the position of the noble metal chip 14 can be adjusted by the positions of the first side surfaces 81*a* and 82*a*, that is, the positions of the searchers 81 and 82. Accordingly, accuracy of the coaxially between the center electrode 12 and the noble metal chip 14 after the provisional bending operation can be improved to a great extent.

By the way, the provisionally bent position of the noble metal chip 14 in the X-axis direction is influenced by an angle portion connecting the first side surfaces 81*a* and 82*a* and the opposite-to-center-electrode surfaces 81*b* and 82*b* of the searchers 81 and 82. Hence it is preferred that such an influence is taken into account in calculating the dimension H.

(Main Bending Process (Step S7 in FIG. 10))

After the provisional bending process, the earth electrode 13 is subjected to a main bending process, in which a not-shown appropriate bending apparatus is driven to finally bend the earth electrode 13 in place. It is therefore possible that the noble metal chip 14 on the earth electrode 13 is finally located in a predetermined tolerance range to meet a desired coaxiality and a gap length with and from the tip 12*a* of the center electrode 12.

The foregoing provisional bending process is therefore very advantageous in the following various points.

First of all, the positions of the searchers 81 and 82 in the center-electrode axial lines Z1 are adjusted work by work (i.e., every spark plug) every time the provisional bending process is performed. Hence accuracy of a high degree can be given to the dimension of the spark plug G after the provisional bending process.

Further, the positions of the searchers 81 and 82 in the X-axis direction are adjusted work by work every time the provisional bending process is performed. Thus, after the provisional bending process, it is possible to have a higher coaxiality between the center electrode 12 and the noble metal chip 14.

Still further, the various geometric dimensions relating to various components including both the electrodes 12 and 13, which are necessary for the provisional bending process, are again measured after the tilt adjusting process (i.e., also after the position adjusting process). As descried, in the position adjusting process, the first shift amount S between the center-electrode axial line Z1 and the earth-electrode axial line Z2 in the Y-axis direction (refer to FIG. 7) is adjusted, while in the tilt adjusting process, the tilt of the earth electrode 13 to the center-electrode axial line Z1 is adjusted. After these adjustment processes, the foregoing measurement is performed again to calculate the target positions to which the searchers 81 and 82 should be moved. Hence the measurement accuracy becomes higher, whereby this high-accuracy measurement results can be used for controlling the positions of the searchers 81 and 82, work by work. This is very effective in further increasing the coaxiality between the center electrode 12 and the noble metal chip 14.

Second Embodiment

Referring to FIGS. 11-12A and 12B, a second embodiment of the present invention will now be described. For the sake of a simplified explanation, components in the second embodiment which are the same or identical as or to those in the first embodiment are referred with the same reference numerals as those in the first embodiment. This usage of the reference numerals will true of a third embodiment described later.

The manufacturing apparatus and method for spark plugs in the second embodiment have a feature that the bending punch 90 is driven to move obliquely to the center-electrode axial line Z1.

In order to realize such oblique movements of the provisional bending punch 90, the second embodiment uses a provisional bending apparatus AP2 equipped with a divided-structure common block, which corresponds to the common block 101 explained in FIGS. 5 and 6. One of divided blocks is arranged obliquely to the center-electrode axial line Z1 in order to move the provisional bending punch 90 at a predetermined oblique angle to the line Z1.

Figure 11:
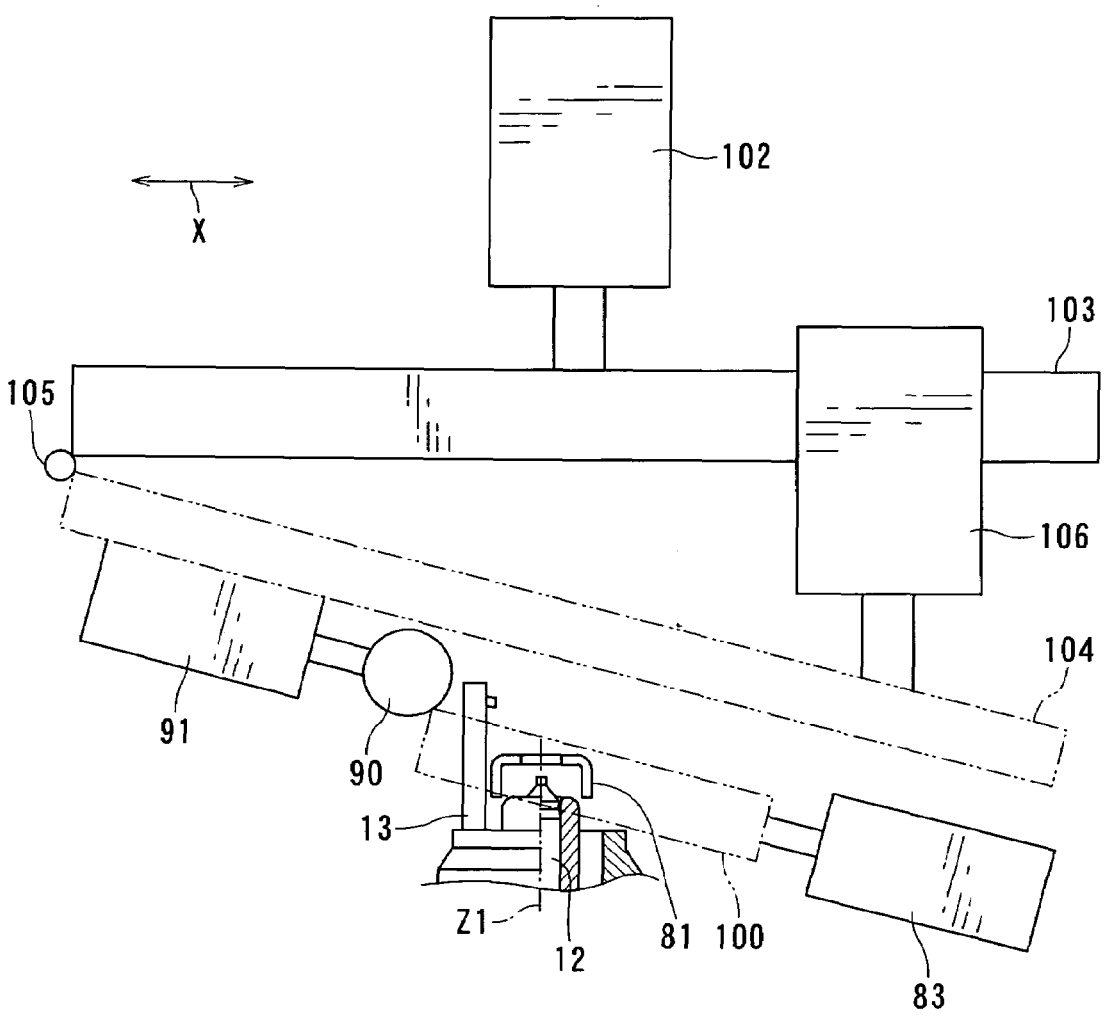
FIG. 11 is a frontal view pictorial showing a provisional bending processing apparatus according to a second embodiment of the present invention.

As shown in FIG. 11, the provisional bending apparatus AP2 according to the second embodiment is the divided-structure common block provided a first common block 103, a second common block 104, and a shaft 105 enabling a relative rotation between the blocks 103 and 104.

To be more specific, both of the first and second blocks 103 and 104 are arranged so that the blocks 103 and 104 can be moved by a block Z-axis driving unit 102 in the center-electrode axial direction Z1. A block rotation driving unit 106 secured to the first common block 103 is in charge of adjusting the angle of the second common block 104 to the first common block 103. Both the searcher X-axis driving unit 83 and the provisional bending punch driving unit 91 are secured to the second common block 104.

In the provisional bending processing apparatus according to the second embodiment, the second common block 104 is inclined to the center-electrode axial line Z1, as above. This will cause the provisional bending punch 90 to move at an oblique angle to the center-electrode axial line Z1. In other words, as the provisional bending punch 90 moves toward the center-electrode axial line Z1, the punch 90 approaches to the tip 12*a* of the center electrode 12.

Figure 12B:
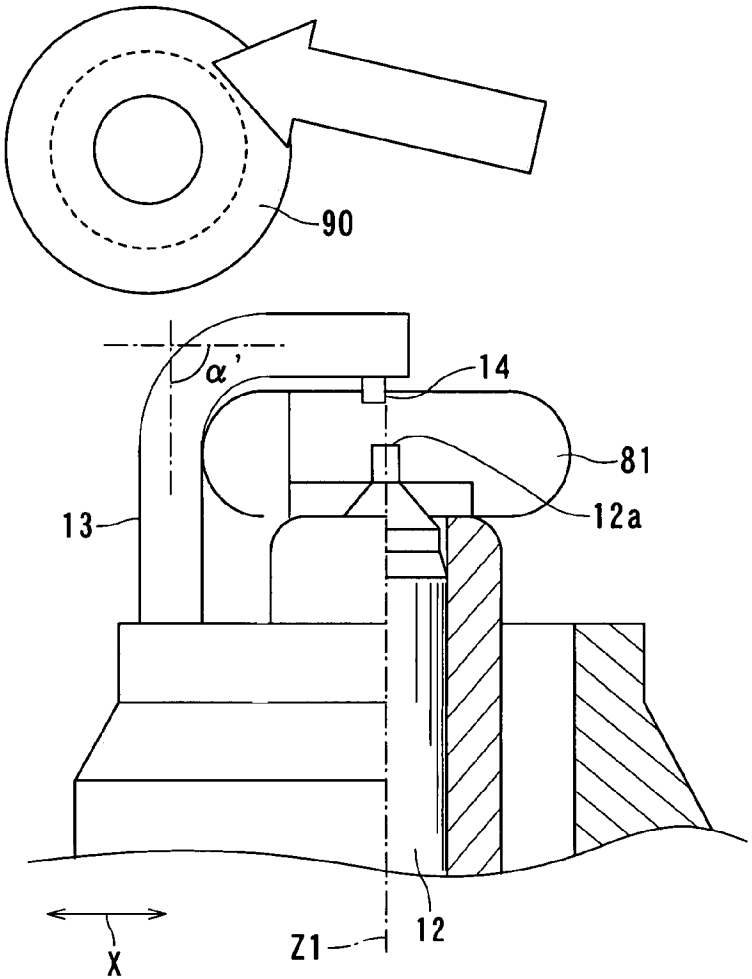
FIG. 12B explains a state of both the earth and center electrodes, in which the provisional bending process for the earth electrode has been completed.
Figure 12A:
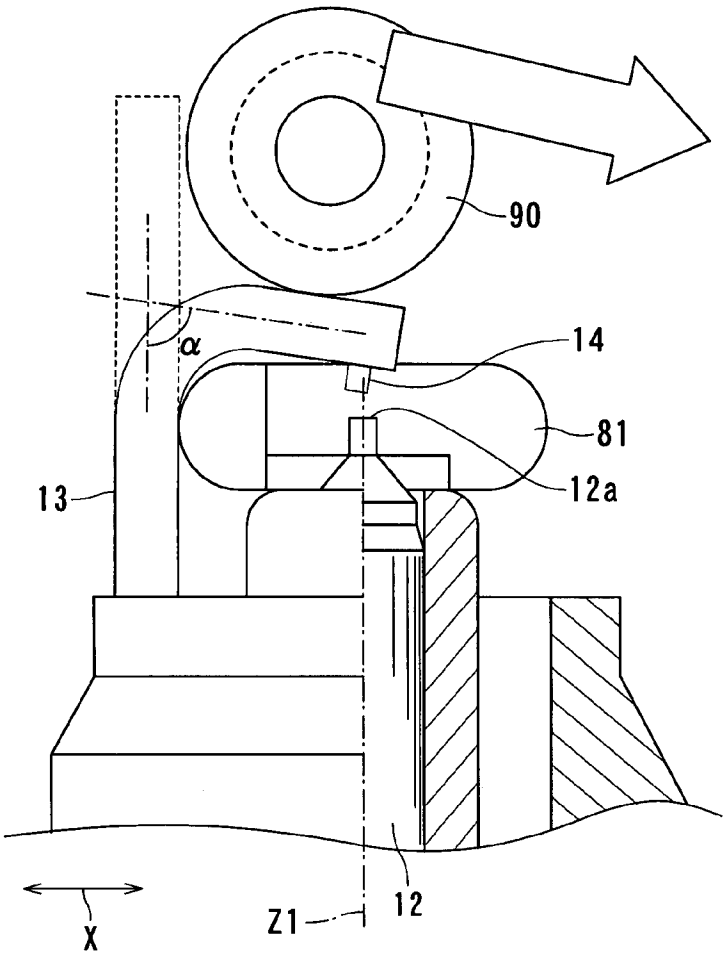
FIG. 12A explains a state of both the earth and center electrodes, in which the earth electrode is under the provisional bending process based on the second embodiment.

The gradually-approaching punch 90 comes in contact with the earth electrode 13 to push it. After the contact, the oblique move of the punch 90 causes the earth electrode 13 to be bent gradually in proportion to the progress of move of the punch 90, as shown in FIG. 12A. Since the provisional bending punch 90 moves obliquely, the earth electrode 13 is bent at an acute angle $\alpha$, as shown in FIG. 12A. On completion of the provisional bending operation, the punch 90 releases the earth electrode 13 from pressing it, which allows the earth electrode 13 to expand its bent angle $\alpha$ to an angle $\alpha'$ of approximately 90 degrees on account of a springback force thereof, as shown in FIG. 12B.

An amount of the bent angle $\alpha$ of the earth electrode 13 is determined such that the expanded bent angle $\alpha'$ after the provisional bending operation is approximately perpendicular to the center-electrode axial line Z1, that is, the chip-mounted surface 13*c* of the earth electrode 13 is substantially as the right angle to the line Z1.

In this way, in deciding the amount of the bent angle $\alpha$ assigned to the provisional bending operation, the springback amount of the earth electrode 13 is taken into consideration. Namely, the earth electrode 13 is bent excessively in expectation of the springback amount owned by the earth electrode 13 itself. It is therefore possible to raise accuracy in the parallelism between the tip face of the noble metal chip 14 and the face of the tip 12*a* of the center electrode 12 when the provisional bending process is completed.

In the above configuration, it is preferred that the oblique angle of the second common block 104 to the center-electrode axial line Z1 is adjusted work by work.

Third Embodiment

Figure 13:
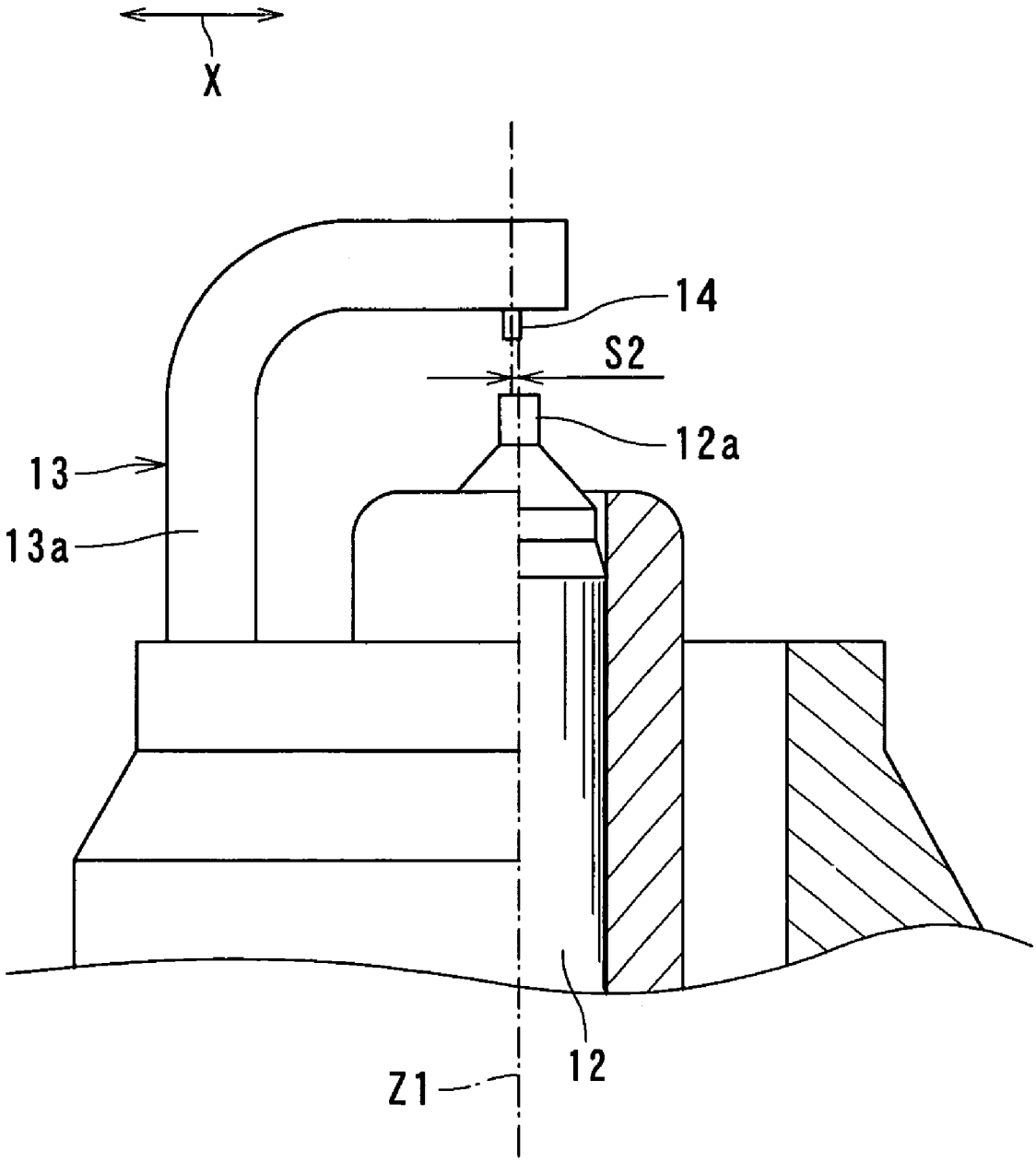
FIG. 13 is a Y-axis directional image taken by the second camera placed in the Y-axis direction in a third embodiment of the present invention, the image being taken after a main bending process and being a view of the predetermined spatial region including the earth and center electrodes.
Figure 14:
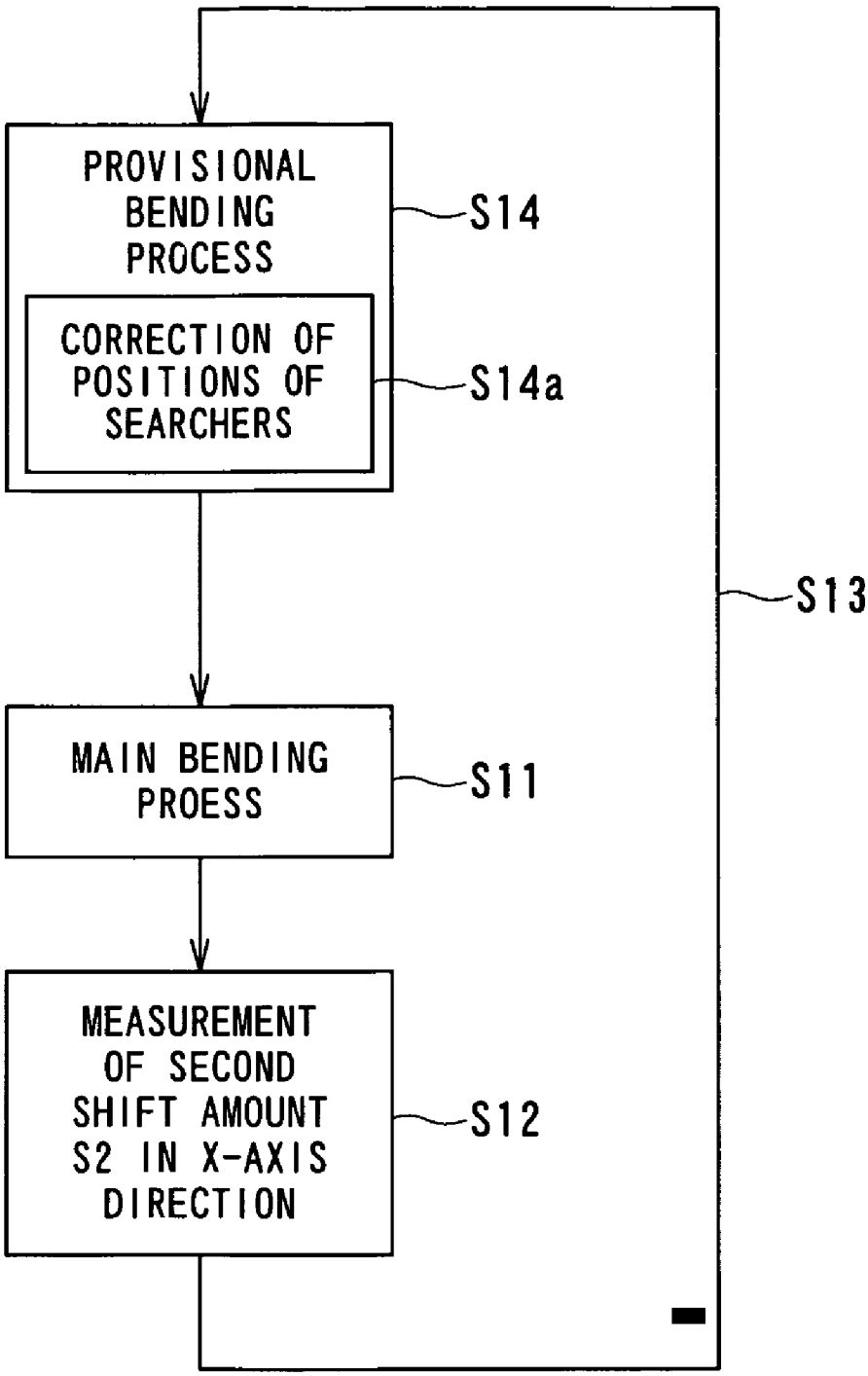
FIG. 14 outlines feedback control of a second shift amount S2 in the X-axis direction, which is carried out in the third embodiment.

Referring to FIGS. 13-14, a third embodiment of the present invention will now be described.

The third embodiment features feedback control of a shift amount S2 between the noble metal chip 14 and the tip 12*a* of the center electrode 12 in the direction (i.e., the X-axis direction) along which the searchers 81 and 82 are moved during the provisional bending operation, the shift amount S2 being measured after the main bending operation. This second shift amount S2 is obtained through the image processing based on image signals from the cameras 41 and 42.

In the present embodiment, after the main bending process to finely adjust the spark gap between the noble metal chip 14 on the earth electrode 13 and the tip 12*a* of the center electrode 12 in the center-electrode axial line Z1, the above shift amount S2 is measured (steps S11 and S12 in FIG. 14). Information indicative of this shift amount S2 is fed back to manufacturing the next work (spark plug) (steps S13 and S14 in FIG. 14). This feedback control is carried out by the foregoing various driving units and the image processor 50 under the control of the controller 60.

One example is shown in FIG. 13, where, after the main bending processing, the noble metal chip 14 is shifted toward the straight base part 13*a* of the earth electrode 13 beyond the center-electrode axial line Z1. In this case, the information indicating that the noble metal chip 14 is shifted toward the straight base part 13*a* is given to the provisional bending process for the next work. Thus, when the next provisional bending process is started, the positions of the searchers 81 and 82 are corrected to new positions stepping away from the straight base part 13*a* (step S14*a* in FIG. 14).

In the opposite situation where the noble metal chip 14 is beyond the center-electrode axial line Z1 toward the opposite way to that shown in FIG. 13, information indicative of this shift is used in the provisional bending process for the next work. That is, using this information, the searchers 81 and 82 are corrected to position closer to the straight base part 13*a* of the earth electrode 13 (step S14*a* in FIG. 14).

In this way, the feedback control of information about the second shift amount S2 is made for the next work, which is makes easier to increase the coaxiality between the center electrode 12 and noble metal chip 14 of the next work.

The present invention may be embodied in other specific forms without departing from the spirit or essential characteristics thereof. The present embodiment and modifications are therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A method for manufacturing a spark plug provided with a housing, a substantially cylindrical center electrode held in an insulated manner in the housing with a tip of the center electrode protruding from the housing, an earth electrode having one end joined to the housing, and a noble metal chip joined on a first end-side surface of an other end of the earth electrode, the earth electrode being bent to form a spark gap between the noble metal chip and the tip of the center electrode, comprising:

providing, for a provisional bending process for the manufacture, the spark plug as a work in a condition where the earth electrode is straight and substantially in parallel with an axial line of the center electrode;

arranging two searchers individually facing the tip of the center electrode with the tip located therebetween, positions of the searchers in a first direction perpendicular to the axial line being adjusted for every spark plug;

driving a bending punch to press a second end-side surface of the other end of the earth electrode down to the searchers so that the earth electrode is provisionally bent at a substantially perpendicular angle to the axial line, the second end-surface being opposite to the first end-side surface;

performing a main bending process to adjust dimensions of a spark gap between the tip of the earth electrode and the tip of the center electrode in the axial line direction of the center electrode;

measuring, after performing the main bending process, a second shift amount between the noble metal chip and the tip of the center electrode in the first direction along which the searchers are adjusted during at least one of the arranging step and the driving step; and correcting, on the basis of the measured second shift amount, the positions of the searchers for the work to be manufactured next.

2. The manufacturing method according to claim 1, further comprising:

deciding the positions of the searchers in the first direction during the provisional bending process on the basis of a height of the noble metal chip from the first end-side surface, a distance from a tip of the noble metal chip to the axial line of the center electrode in the first direction, which is observed before the provisional bending process, and a distance from an axial line of the noble metal chip to the tip of the center electrode in the axial line of the center electrode, which is observed before the provisional bending process.

3. The manufacturing method according to claim 1, further comprising:

deciding an amount of bending of the earth electrode in consideration of a springback amount of the earth electrode to occur when the earth electrode is released from being pressed by the bending punch, the earth electrode being bent at the decided bending amount.

4. The manufacturing method according to claim 3, further comprising:

moving the bending punch obliquely to the axial line of the center electrode for the provisional bending operation of the earth electrode.

5. The manufacturing method according to claim 4, wherein said bending punch is moved so that the bending punch comes nearer to the tip of the center electrode as the bending punch moves in the direction perpendicular to the axial line of the center electrode.

6. The manufacturing method according to claim 1, wherein the second shift amount is obtained through image processing based on image signals from at least one camera.

* * * * *